United States Patent [19]

Cory

[11] 3,942,799

[45] Mar. 9, 1976

[54] BOARD GAME APPARATUS

[75] Inventor: Richard G. Cory, Laurelton, N.Y.

[73] Assignee: Corwin Games, Inc., North Bellmore, N.Y.

[22] Filed: Jan. 30, 1974

[21] Appl. No.: 437,936

[52] U.S. Cl. ..... 273/134 AD; 273/134 GP

[51] Int. Cl.[2] ..... A63F 3/00

[58] Field of Search ..... 273/131, 134

[56] References Cited

UNITED STATES PATENTS

| | | | |
|---|---|---|---|
| 1,628,134 | 5/1927 | Finlay | 273/134 D X |
| 1,738,582 | 12/1929 | Johannessen | 273/134 D |
| 2,042,645 | 6/1936 | Webb | 273/134 E |
| 3,467,387 | 9/1969 | Schmitt | 273/134 AC |
| 3,773,326 | 11/1973 | Thiele | 273/134 C |
| 3,787,056 | 1/1974 | Hellmann | 273/134 D |

*Primary Examiner*—Delbert B. Lowe
*Attorney, Agent, or Firm*—Philip D. Amins

[57] ABSTRACT

A game arrangement in which a printed board or sheet is provided with a plurality of relatively large playing areas representing airports. A course is provided between the airports which is divided into three parallel paths adapted to be used by color coded airplane tokens owned by the respective players. The ownerships of the airplane tokens as well as instructions for their taxi and take-off, mileage to be flown, penalty and rewards to be received by a player when his airplane token lands at each airport, are obtained by picking cards from a deck of cards having such indicia or instructions indicated thereon. A single die also is provided which is used to multiply the penalties and rewards.

9 Claims, 5 Drawing Figures

BOARD GAME APPARATUS

BACKGROUND OF THE INVENTION

The present invention relates to a board game apparatus, and more particularly to a board game apparatus of the type having a designated course or a plurality of parallel playing paths provided on the board through which player owned airplane tokens move in a manner determined by both chance and skill until a specified sum of money is earned.

The type of game of the present invention is that in which a substantially flat playing board is utilized, the upper surface of which is provided with suitable representations or markings indicating a playing course which includes a plurality of airports, relatively large playing areas, and generally three parallel paths between airports representing flight paths therebetween. Each path has a different number of a plurality of effective relatively small playing areas, representing the different amounts of mileage traveled by different type airplanes relegated to each of the respective paths during the play of the game, in accordance with the rules of the game. During play, the playing pieces or tokens simulating airplanes owned by the individual players are moved through their respective flight paths as indicated by cards held and then discarded by each player in turn in accordance with a variety of situations presented by said cards, whereby each of the players, by the elements of chance and skill, tries to accumulate or earn a prescribed amount of money, e.g., $20,000.00, to be declared the winner, whereupon the game is terminated.

Many of the board games known in the prior art merely involve movement of the players' tokens through the playing path or course in a manner determined by chance in accordance with means such as dice, a dial indicator or pointer arranged to be spun and the like. The game is thus reduced to a game of chance with little skill involved. However, the present invention combines both skill and chance and presents a challenge to the players and causes them to use their skill and their intelligence in acquiring the prescribed sum of money needed to be declared the winner.

SUMMARY OF THE INVENTION

Accordingly, a primary object of the present invention is to provide a new and novel board game apparatus.

Another object of the present invention is to provide a new and novel board game apparatus which requires the exercise of good judgment, skill and the like, by the players during the competitive play so that the winning player is determined by his superior acumen.

A further object of the present invention is to provide a new and improved game apparatus which is simple in construction, inexpensive to manufacture, and which improves both amusement and education for the participating players.

A board game apparatus for a plurality of players, according to the principles of the present invention, comprises in combination: a playing board, a plurality of relatively large equal playing areas on the board, a course positioned between the large areas divided into a plurality of parallel paths, each path being divided into a plurality of relatively small equal areas with a different number of the small areas in each path. A plurality of each of a plurality of distinctive tokens constituting playing pieces for the respective players are included, each distinctive token being adapted to be used in a corresponding identifiable path, in accordance with the rules of the game. The tokens have means for indicating ownership by any one of the players and means for concealing a player selectable indicia thereon.

A group of monetary tokens for payment of rewards to and penalties by players whose tokens advance to said relatively large playing areas is also included, as well as a deck of cards, each card of the deck of cards having indicia thereon indicating ownership of a token, starting of a token, the number of small playing areas to be moved by a player's token and penalties and rewards to be paid or received by the player coming into possession thereof, respectively.

DESCRIPTION OF THE PREFERRED EMBODIMENT

Figure 1:
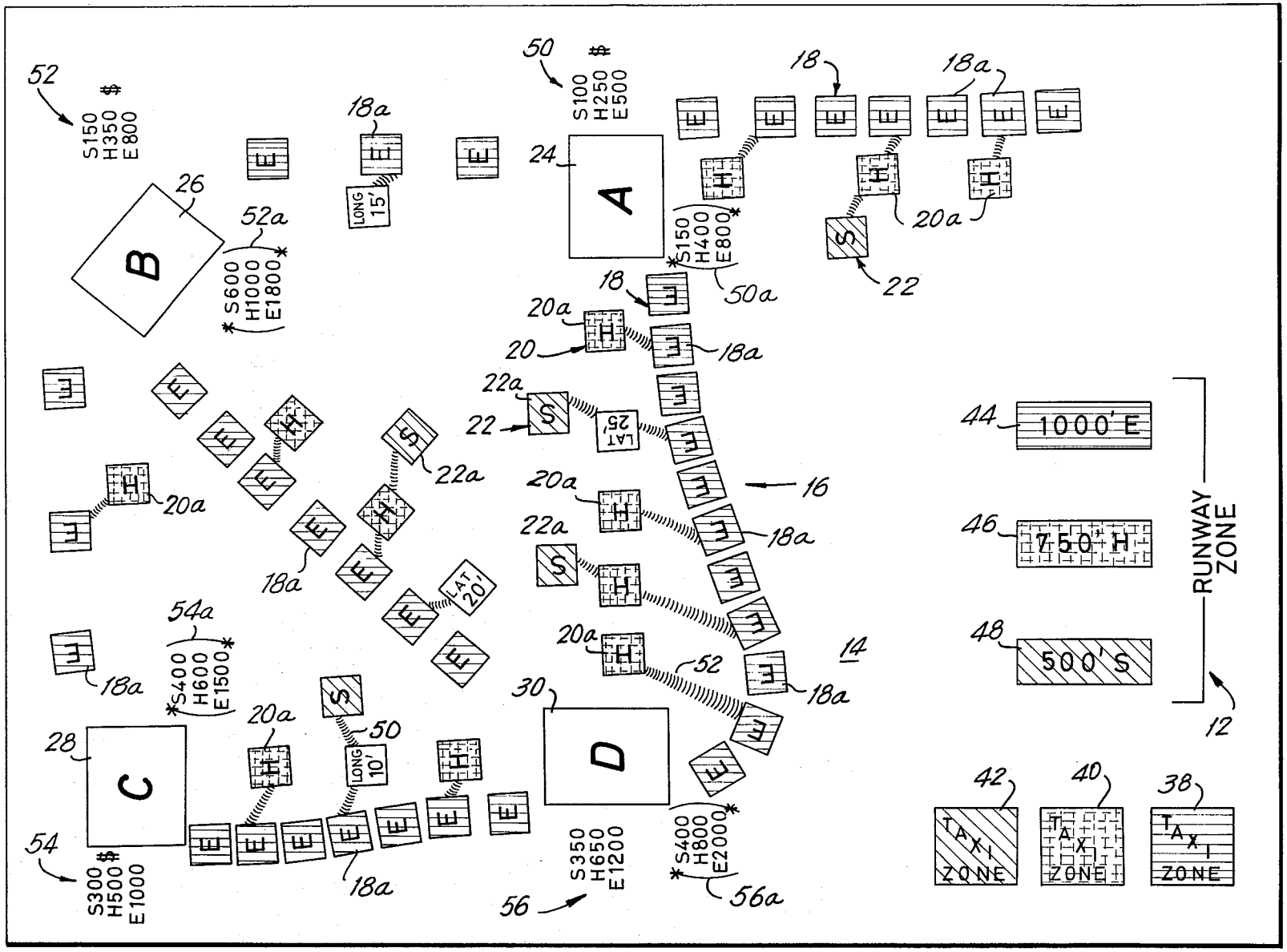
FIG. 1 is a plan view of a playing board for a board game apparatus constructed in accordance with the invention, portions of which are suitably colored according to the color symbols for draftsmen prescribed in 37 CFR 3.61 (1974).

Referring now to the drawings, and to FIG. 1 in particular, the game apparatus of the invention includes a playing surface which is preferably in the form of a board designated generally by the numeral 12 thereon. In the preferred embodiment, the board 12 is substantially rectangular as shown and contains an upper surface 14 on which is provided, by printing or the like, suitable indicia and graphic illustrations in accordance with the invention, as will be explained hereinafter. While any name suitable for the game apparatus of the invention may be employed, the game is preferably referred to as "Take Off", a name which suggests the playing aspects of the game.

In order to provide a playing field for the players, a playing path or main course, designated generally by the numeral 16, is divided into generally three different paths 18, 20 and 22, which preferably are colored blue, yellow and green, respectively. The paths 18, 20 and 22 are each divided into relatively small playing areas **18*a*, 20*a*, and 22*a*, respectively. A different number of playing areas are provided in each of the playing paths. Preferably, path 18 is divided into the largest number of relatively small playing areas, path 20 the next largest number of playing areas and path 22 is divided into the smallest number of playing areas. The playing areas 18*a*, 20*a* and 22*a* preferably form three generally parallel paths or a course 16 which is positioned between a plurality of generally larger playing areas 24, 26, 28 and 30.** The larger playing areas include indicia A, B, C and D, respectively, which represent the names of various airports. Each of the relatively small playing areas represents the distance that would be traveled by three different types of airplanes with 400 gallons of fuel traveling between airports A, B, C and D.

The course 16 is divided into three different paths which are relegated to be flown by the three different types of airplanes.

Figure 2:
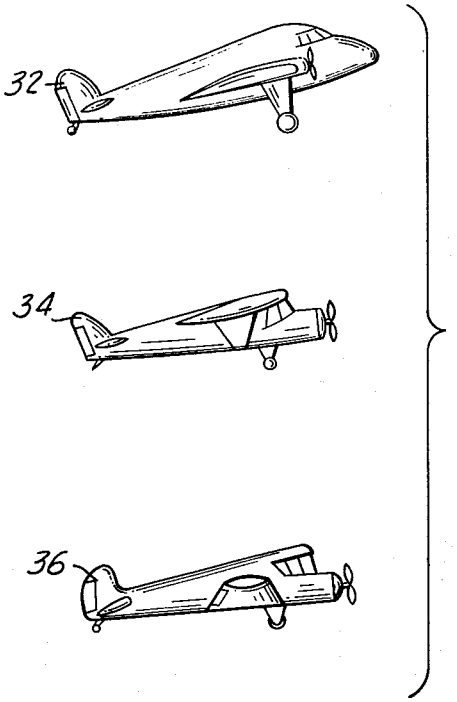
FIG. 2 is a pictorial representation of airplane tokens used as playing pieces by the players.

The airplanes preferably are colored the same colors as the paths they use during the play of the game pursuant to the game rules. The three types of airplanes 32, 34 and 36 are shown in FIG. 2 and are known as the "Eagle," "Hawk" and "Sprint," respectively. There are two deeds for two Sprint airplanes, two Hawk airplanes and one Eagle airplane which may be owned by the players; however, the players may also purchase Hawks and Eagles from the bank at a cost of $500 and $1000, respectively. Only one Sprint airplane 36, however, may be deeded to each player. A player may own more than one Sprint airplane only if he captures another player's Sprint airplane in a manner to be described hereinafter.

Each of the airplanes are provided with indicia for indicating the ownership of the airplane by a player. In the preferred embodiment of the invention, colored rubber caps which are adapted to be placed on the upper surface or antenna of the airplane are provided. Also, the under surface of the airplane wing is preferably provided with the numeral 5 or 10 thereon to represent the altitude that the plane will fly at during the game. The purpose for the altitude designation will become apparent when the play of the game is explained.

The upper surface 14 of the playing board 12 is also provided with three medium sized playing areas 38, 40 and 42, each of which preferably are colored the same color as the paths 18, 20 and 22, respectively. These areas are known as the "taxi areas" or starting areas and are to be used by the correspondingly colored airplanes during the play of the game. Additionally, included on the upper surface 14 of the board 12 are three elongated areas 44, 46 and 48 which represent the "runways" or holding areas to be used by the airplanes, Eagle 32, Hawk 34 and Sprint 36, respectively, when permitted during the play of the game.

The amount of money that the owner of each airplane is to receive when a player's lands on any of the airports, A, B, C or D (24, 26, 28 or 30) is printed alongside each airport and is designated 50, 52, 54 and 56, respectively. Each type of airplane, Eagle 32, Hawk 34 or Sprint 36 receives a different fee from the bank for landing at each airport when flying (moving) in a counter-clockwise direction as follows:

| | Airport "A" | Airport "B" | Airport "C" | Airport "D" |
|---|---|---|---|---|
| Sprint | $100 | $150 | $300 | $350 |
| Hawk | 250 | 350 | 500 | 650 |
| Eagle | 500 | 800 | 1000 | 1200 |

When flying in a reverse or clockwise direction, the airplane landing fees are as follows:

| | Airport "A" | Airport "B" | Airport "C" | Airport "D" |
|---|---|---|---|---|
| Sprint | $150 | $600 | $400 | $400 |
| Hawk | 400 | 1000 | 600 | 800 |
| Eagle | 800 | 1800 | 1500 | 2000 |

Figure 3:
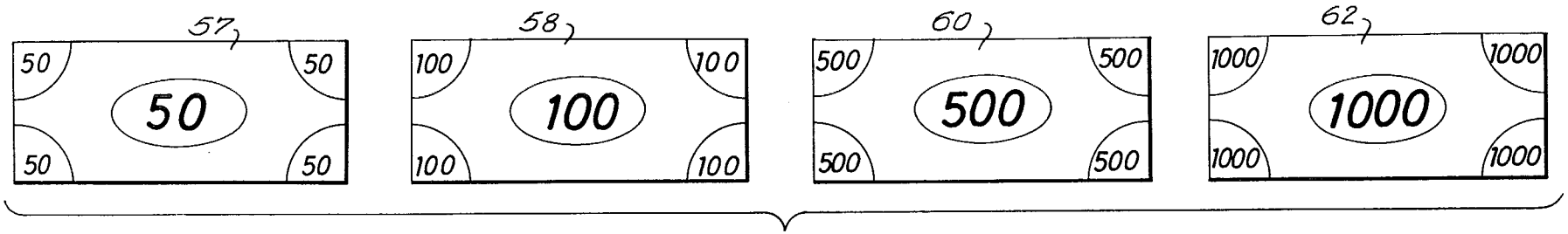
FIG. 3 shows various denominations of monetary tokens or play money that are employed in connection with the present invention.

The money tokens, play or simulated money, are provided in various denominations for the play of the game and are shown in FIG. 3. The money may be of any suitable denominations and preferably is provided in denominations of $50, $100, $500 and $1,000, as shown at 57, 58, 60 and 62, respectively, in FIG. 3.

Figure 4:
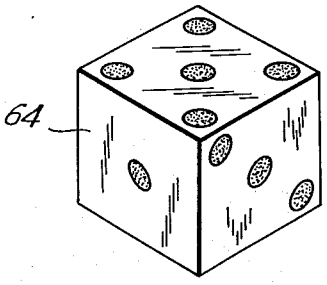
FIG. 4 shows a single die which is employed in the present invention.

FIG. 4 illustrates a single die 64 which is used to multiply the penalties and rewards as will be explained hereinafter.

A deck of cards 66 which includes individual cards having indicia thereon representing thirteen different types is provided. These types of cards preferably indicate, for example, such items as: ownership of an airplane, taxying of an airplane, take-off of an airplane, the number of small playing areas to be moved by a player's airplane by application of the rules to convert fuel into the number of areas to be moved, and the penalties and rewards to be paid or received by a player coming into possession thereof during the course of play.

Figure 5:
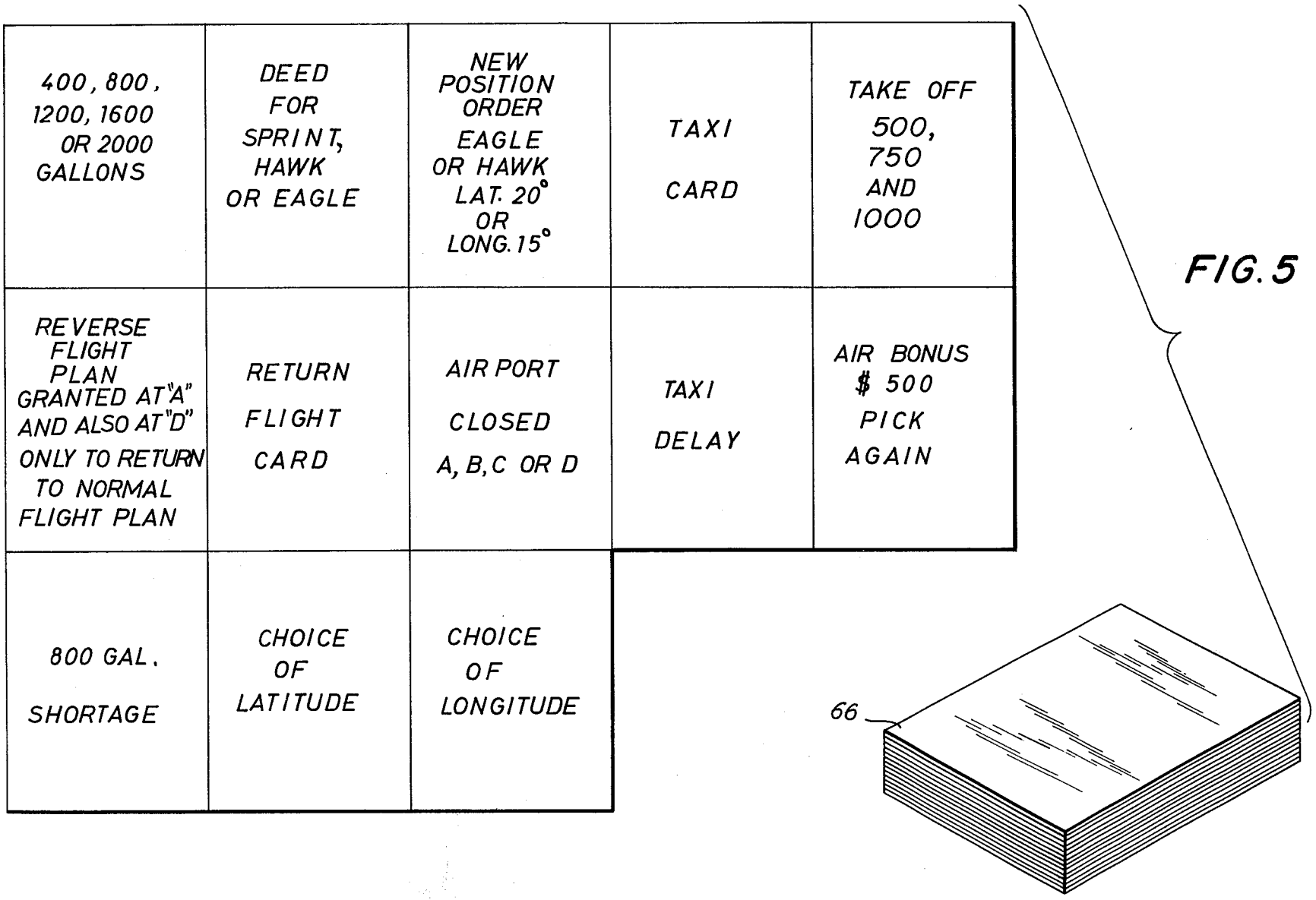
FIG. 5 shows the designations on the respective cards forming the deck of cards that is a part of the present invention.

The indicia on the different types of cards are shown in FIG. 5.

The quantity of each of the different types of cards is shown in the table below:

| Type of Card | Indicia on Card | Quantity |
|---|---|---|
| Fuel | 400 Gallons | 33 |
| Fuel | 800 Gallons | 14 |
| Fuel | 1200 Gallons | 3 |
| Fuel | 1600 Gallons | 6 |
| Fuel | 2000 Gallons | 4 |
| Deed | Deed For Sprint | 2 |
| Deed | Deed For Hawk | 2 |
| Deed | Deed For Eagle | 1 |
| New Position Order | Eagle to Longitude 10° | 1 |
| New Position Order | Eagle to Longitude 15° | 1 |
| New Position Order | Eagle to Latitude 20° | 1 |
| New Position Order | Eagle to Latitude 25° | 1 |
| New Position Order | Hawk to Longitude 10° | 2 |
| New Position Order | Hawk to Longitude 15° | 2 |
| New Position Order | Hawk to Latitude 20° | 2 |
| New Position Order | Hawk to Latitude 25° | 2 |
| Warm-UP | Taxi Card | 17 |
| Starting | Take-Off 500 | 2 |
| Starting | Take-Off 750 | 10 |
| Starting | Take-Off 1,000 | 7 |
| Flight Plan | Reverse Flight Plan | 7 |
| Flight Card | Return Flight Card | 12 |
| Airport Penalty | Airport Closed A | 1 |
| Airport Penalty | Airport Closed B | 1 |
| Airport Penalty | Airport Closed C | 1 |
| Airport Penalty | Airport Closed D | 1 |
| Taxi Penalty | Taxi Delay | 4 |
| Fuel Shortage | 800 Gallon Shortage | 5 |
| Bonus | $500 Air Bonus | 2 |
| Latitude | Choice of Latitude | 2 |
| Longitude | Choice of Longitude | 2 |

The principles of the game are best described by a complete presentation of the rules of the game with examples to explain certain rules which may appear difficult to understand. At the start of play one of the players is placed in charge of the Bank and this player handles all the money for the Bank prior to beginning the game and during the game. The player in charge of the Bank participates in the game in the manner of regular players. Prior to the beginning of the game no money is given to any of the players. The first player to accumulate the sum of $20,000 of the play money by flying his planes around the board is declared the winner of the game. The game of the present invention may be played by two or more people or teams. At the start of play the players are not given money or airplanes. Planes may be acquired by purchasing them with money obtained by selling gas to the Bank or by picking a deed therefor from the deck of cards. Any player, by mutual agreement of the players, deals five cards face down, one at a time, to all of the players. The player to the left of the dealer draws a card from the remaining cards in the deck. All the players look at the cards set before them and they are required to pick an additional card from the deck before playing one when it becomes their turn. All of the players should familiarize themselves with the various types of cards and their applications before starting the play of the game to enable each player to make the best use of the cards in his possession.

The player drawing first has six possible moves:

1. If the player picks a New Position Order card, but owns no airplane, he must discard it immediately by placing it on the discard pile.

2. He must lay down an Airport Closed card in his own playing area, in front of him.

3. He may sell a gas card to the bank for money.

4. He may hold the card he drew and any future one, but may never hold more than a maximum of ten cards.

5. He may play an 800 Gallons Shortage card in front of any opponent he chooses.

6. He may trade in a deed for the specified airplane or sell it for the listed value and pick again.

Note: Whenever a New Position Order card is picked it takes precedence before all other cards and it must be played (discarded) immediately.

The functions of the several different cards are as follows and the cards may include indicia thereon pictorially representing their function:

The Taxi card allows any plane to move into the Taxi Zone 38, 40 or 42. A player would ordinarily, at the next opportunity, play a runway Take-Off card.

The Take-Off card, when played, permits any plane in the Taxi Zone to advance to the runway 44, 46 or 48. On the next turn a player may play a Gas (Fuel) card and move the appropriate number of small boxes (areas) related to the type of airplane. The plane is now considered "On The Board."

Example: To take-off with a blue-colored Eagle airplane 32 requires a card that reads "Take-Off 1000". A card reading "Take-Off 750" cannot be used since it applies only to a yellow-colored Hawk airplane (in accordance with the playing rules of the game).

Gas (Fuel) cards may be sold to the bank at a price of $100 for each 400 gallons indicated thereon. Only one card may be sold each turn.

Example: A 1200 gallon card is worth $300. Only one gas card may be used each turn to move a single airplane and all the fuel listed must be used by the plane selected. Fuel cards may not be divided among airplanes.

Example: If all three type planes were sitting on their Runway Zones, and each were to be capable of propulsion by an 800 gallon card:

a. The Sprint would move twice (two small areas) to land on port A and collect flight pay.

b. The Hawk would also move two spaces (small areas) and now be midway between the runway and airport A.

c. The Eagle would move two spaces (small areas) and now be only one-fourth of the way to A.

Example: With all three planes on the runway:

a. A 1600 gallon card would land the Sprint directly on C allowing it to collect for the bypassed ports A and B. It is to be noted that for purposes of plane movement, the ports are considered to be the equivalent of one of the small playing areas.

b. Land a Hawk directly on A to collect the landing fee.

c. Position an Eagle midway (on the fourth blue box) between the Runway Zone and port A.

The Deed cards may be traded by the holder thereof for the specified airplane indicated thereon or the holder may accept the money value on the card ($500 for all planes) and immediately pick again.

The Air Bonus cards entitle the holder to $500 which is paid by the bank and entitles the holder to immediately pick again.

A Latitude or Longitude card entitles the holder thereof to elect to move any plane he has on board (in flight) to the effective position stated on the card when it is his turn. This permits:

a escape from pursuing planes;

b. landing directly on another plane to challenge it;

c. repositioning a plane to a position where it may land to collect more money.

Note: that a Sprint airplane can never land on a Longitude 15° or a Latitude 20° since there is no particular green box for that plane at this longitude and latitude between airports.

A New Position Order card, as noted earlier, must be played immediately. If a player has a Hawk Position Order, and he has that plane on board, he moves it to that position. If the player has two Hawks on board, he may choose which plane he wants to move to that new box. If a player has two Hawks or Eagles on board and one is already sitting on the box specified by the Position Order, he must move the other one to that new position.

When players move to these new positions, it does not count as "Bypassing" and no money is put up by the bank at the passed airports for other planes to collect. Note: If a player has a plane on the Taxi or Runway Zone, it moves to the new stated position.

All planes fly in a normal flight order (counterclockwise). To increase the amount of money a plane can earn, a player may fly his plane clockwise by submitting a Reverse Flight Plan card simultaneously with his Gas card for any of his planes. This is done when his plane is sitting on airport A. The plane is then faced heading towards D. Once in Reverse Order, every time the plane lands to collect, it must submit a Return Flight card at the same time with the final Gas card used to land it. The plane then collects the higher pay listed in parentheses, viz., 50*a*, 52*a*, 54*a* and 56*a*. Continuing in Reverse Order, planes need only submit a Return Flight card every time they land at an airport. All planes in this order (Reverse) must always land directly at each airport, never bypassing. It is noted that a player's mobility is limited by the amount of "Return Flight" cards he has saved in his hand. All planes are entitled to collect any forfeited money left at an airport by other planes including the player's own whenever landing there first.

There are only two ways for a plane to resume normal flight order (counter-clockwise).

1. If the plane receives a New Position Order to Latitude 20°, it is faced heading toward B. When landing there, it is forced to return to normal flight order.

2. The player submits another Reverse Flight card at D entitling him to fly to B, thus returning to normal flight order. The plane is then faced heading toward C indicating its new direction of flight.

A Return Flight card is submitted at the same time a Gas card is submitted whenever landing a plane which is flying in Reverse Flight Order (clockwise) at an airport.

The 800 Gallon Shortage card is played on any opponent the holder wants to prevent from further movement on the board. The receiver may, when it is his turn, only remove it by turning in an 800 Gallon or two 400 Gallon Gas cards at once. If a player has two of these cards in front of him, he can pay them off with one 1600 Gallon card. Money can never be used to buy gas. A player cannot use a 1600 Gallon card to pay off a smaller 800 Gallon Shortage.

A player with an 800 Gallon Shortage card in front of him may still make any other transactions but never move a plane.

When a Taxi Delay card is placed on the discard pile, the holder may choose any airplane of any player in the Taxi Zone to be removed from the Taxi Zone (board). This requires the owner of the removed airplane to submit another Taxi card for the airplane to regain its former position.

The Airport Closed card is the only card played against the player when it is picked. There are only four in the deck, one for each airport. Having drawn one, the player immediately puts it down in his own area. To remove it, he must land directly on the closed port with any one of his planes. He then pays the flight pay for the type plane that he landed from his own savings in exchange for the port opening again to his planes. This forfeited pay is then placed by the reopened port for the very next player landing there to collect. A player who just opened his port may fly around the board, or by repositioning his plane with a Choice of Latitude card or a Choice of Longitude card can be the first to land there and claim his own lost pay plus the flight play for the plane he just landed.

A player may fly over his closed port by not landing directly on it. The lost flight pay for bypassing it is put up by the player and is available for the next airplane landing there. A plane bypassing an airport in this manner still collects for any other open port it lands on.

A player who lands and collects another's lost pay must elect to roll a die and try to increase its value. If there is $500 or less on an airport, the player rolls one die. A roll of 1, 2 or 3 is the amount by which the money is multiplied for the roller to collect. A 4, 5 or 6 is that figure in hundreds of dollars the player now owes minus the amount of money already there.

Example: A roll of 2 against $500 at the airport permits the roller to collect $1000 in addition to the flight pay for landing.

Example: A roll of 6 against $500 at the airport means the player must add $100 of his own money to the $500 already there making it $600 that the next incoming plane collects upon landing.

When there is $550 or more at the airport when a plane lands, 1, 2 or 3 is again the value by which the money is increased for the roller to collect in addition to the flight pay for landing. A 4, 5 or 6 rolled is now doubled as the money which the player now owes less the amount of money already there.

Example: A roll of 2 against $700 means the player collects $1,400 plus his flight pay for landing.

Example: A roll of 5 against $700 means the player owes $1000 and puts up the additional $300 for the next incoming plane.

Example: A roll of 5 aginst $1100 entitles the player to take $100 leaving the remaining $1000 he owes. Note: a Sprint is a valuable plane to own. It is able to race ahead of slower planes to collect forfeited money and it is able to open closed ports at a small cost to the owner.

A plane may collect when bypassing an airport if it lands directly on another airport while flying in normal flight order only.

Example: A Sprint sitting on C may move five boxes with a 2000 Gallon card to land on A. Although it bypassed D, because it landed directly on A, it collects for both ports.

Example: A Hawk moving two boxes from A lands between two ports B and C. In so bypassing B, but having failed to land directly on the next airport C, the flight pay for that type plane had it landed on B is forfeited to that port by the bank for the next incoming plane to collect.

Challenging occurs whenever a plane lands on a box already occupied by another plane. Planes entitled to Challenge are those that are the same color-type and planes that are smaller than the plane they have landed on.

Example: A yellow Hawk can challenge another Hawk just as blue Eagles can challenge other Eagles.

Example: A Sprint which is the smallest plane may challenge the next larger Hawk whenever their boxes are linked together by the red radar lines 50. The Sprint may not challenge an Eagle.

Example: The Hawk can challenge the larger Eagle when their playing area boxes are linked together by the red radar lines 52.

Note: Larger planes NEVER challenge smaller planes.

Before placing his airplane token on the board, a player must provide a marking of either 5 or 10 under the wing. This represents the altitude at which the plane will fly. The player landing in the same square as another plane has the right to "Challenge". The two players then negotiate for the possible release of the captured plane. The challenger may ask any amount of money or valuable cards the other may be holding for the release of the plane. (Any value the two agree upon is acceptable). Or the challenger may not ask any ranson, thereby forcing both planes to turn over and show their flying altitude. If the numbers match, the challenger has won. The challenger then takes possession of the plane and assumes the plane position exactly where it sits on the board. He then changes the indicia of ownership to his own flying color. Should the two numbers not match, the challenged plane flies free and the owner is paid $200 by the challenger for delaying him.

The additional rules of play include the following:

1. When the complete deck of cards has been picked, the discarded cards are reshuffled and the new pile is started again, obeying the indicia on all cards as before.

2. There is no limit to the number of airplanes that can share the Taxi Areas, Runway Areas and any other Areas on the board.

3. Any trading or sale of cards for any value is acceptable on a player's (purchaser's) turn.

4. Generally only one Sprint airplane may be owned by each player in a game. The only way a player may own more than one Sprint airplane is to capture one from another player during a "Challenge."

It will be understood that various changes in the details, materials, arrangements of parts and playing conditions which have been herein described and illustrated in order to explain the nature of the invention may be made by those skilled in the art within the principles and scope of the invention.

Hereinbefore has been disclosed a board game apparatus which is suitable for adults as well as children and will provide amusement as well as tax the acumen of the players. Although chance is a consideration in the game, a player with an agile mind and with investing ability can rapidly improve his financial position to obtain $20,000 and be declared the winner of the game.

What is claimed is:

1. A board game apparatus for a plurality of players comprising in combination:

a playing board, a plurality of relatively large equal playing areas on said board, a course positioned between said large areas divided into a plurality of parallel paths, each said path being divided into a plurality of relatively small equal playing areas with a different number of said small areas in each said path;

a plurality of each of a plurality of distinctive tokens constituting playing pieces for the respective players, each distinctive token adapted to be used in a corresponding identifiable path, said tokens having means for indicating ownership by any one of said players and means for concealing a player selectable indica thereon;

a group of monetary tokens for payment of rewards to and penalties by players whose tokens advance to said relatively large playing areas;

a deck of cards, each card of said deck of cards having indicia thereon with reference to the playing rules which indicate, respectively, ownership of a token, starting of a token, the number of small playing areas to be moved by a player's token and penalties and rewards to be paid or received by the player coming into possession thereof.

2. A board game apparatus according to claim 1, wherein said playing board further includes a plurality of holding areas and a plurality of starting areas having indicia thereon designating in accordance with the playing rules that the player tokens be held in place, said starting areas corresponding in color to said parallel paths.

3. A board game apparatus according to claim 1, wherein each said plurality of paths is of a different color and each distinctive playing piece is correspondingly colored.

4. A board game apparatus according to claim 1, wherein said distinctive tokens simulate airplanes, and said concealed selectable indicia is located on the underside of said simulated airplane.

5. A board game apparatus according to claim 1, wherein said deck of cards includes one hundred fifty-one cards of thirteen different types.

6. A board game apparatus according to claim 1, wherein said game includes one die used in multiplying said penalties and rewards.

7. A board game apparatus according to claim 1, wherein said plurality of parallel paths comprises three paths and said plurality of distinctive tokens comprises three distinctive tokens.

8. A board game apparatus according to claim 1, wherein said relatively large playing areas number four.

9. A board game apparatus for a plurality of players comprising in combination:

a playing board including four relatively large playing areas representing airports, a course positioned between at least two of said large areas divided into three color-coded parallel paths, each said path being divided into relatively small equal playing areas representing a theoretical distance which consumes a predetermined amount of fuel, a plurality of each of three distinctive tokens having the general shape of an airplane and adapted to be used in a correspondingly color-coded path, said airplane tokens having means for indicating ownership by any one of said players, each said airplane further including a player selectable indicia representing altitude on the underside thereof, a group of monetary tokens for payment of rewards to and penalties by players whose tokens advance to said relatively large playing areas, a single die used to multiply said penalties and rewards, a deck of cards, each card of said deck of cards having individual indicia thereon indicating: ownership of an airplane, taxying of an airplane, take-off of an airplane, the number of small playing areas to be moved by a player's airplane and penalties and rewards to be paid or received by players coming into possession thereof.

* * * * *